United States Patent [19]

Sakamoto

[11] Patent Number: 4,628,675

[45] Date of Patent: Dec. 16, 1986

[54] TAPE WINDING APPARATUS

[75] Inventor: Katsuji Sakamoto, Kanagawa, Japan

[73] Assignee: Sumitomo Electric Industries, Ltd., Osaka, Japan

[21] Appl. No.: 580,310

[22] Filed: Feb. 15, 1984

[30] Foreign Application Priority Data

Feb. 17, 1983 [JP] Japan ..... 58-25994

[51] Int. Cl.[4] ..... D07B 7/14; B65H 59/18

[52] U.S. Cl. ..... 57/3; 57/13; 57/264

[58] Field of Search ..... 57/3, 13, 264, 1, 10

[56] References Cited

U.S. PATENT DOCUMENTS

| | | | |
|---|---|---|---|
| 1,319,982 | 10/1919 | Wieczoreck | 57/3 |
| 1,330,050 | 2/1920 | Beaver et al. | 57/3 |
| 2,253,740 | 8/1941 | Van Hook | 57/3 X |
| 2,875,570 | 3/1959 | Sarracino | 57/13 |
| 3,006,136 | 10/1961 | Grieve et al. | 57/3 |
| 3,590,567 | 7/1971 | Bonikowski | 57/3 |
| 3,756,004 | 9/1973 | Gore | 57/3 X |

FOREIGN PATENT DOCUMENTS

| | | | |
|---|---|---|---|
| 493835 | 10/1938 | United Kingdom | 57/3 |

*Primary Examiner*—Stuart S. Levy
*Assistant Examiner*—Joseph J. Hail, III
*Attorney, Agent, or Firm*—Sughrue, Mion, Zinn, Macpeak, and Seas

[57] ABSTRACT

A tape winding apparatus including a rotatable spindle having an axial bore through which a core on which a tape is to be wound to produce a cable is advanced, and a reel carrying a roll of tape supported on the spindle for rotation about the core. A takeup roller is provided between the reel and the core for defining at least two areas therebetween so that the tension of the tape in one of those areas which is closer to the reel may be higher than in the other area. A wind barrier is provided between those areas for preventing transfer of a wind created by the rotation of the reel from the one area to the other area. A tension controller is provided between the takeup roller and the core for controlling the rotating speed of the takeup roller to maintain the tape therebetween at a satisfactorily low tension which ensures proper winding of the tape on the core.

5 Claims, 5 Drawing Figures

TAPE WINDING APPARATUS

BACKGROUND OF THE INVENTION

1. Field of the Invention

The present invention relates to an apparatus for winding a tape spirally on a core for insulation or other purposes in the manufacture of an electric wire or cable.

2. Description of the Prior Art

A conventional apparatus for winding two tapes on a core is shown in FIGS. 1 and 2. The apparatus includes a spindle 1 having an axial bore defining a core passage, and supported rotatably on a stand 3 by bearings 2, 2'. A pulley 12 is attached to the spindle, while another pulley 14 is connected to the output shaft of a motor 13. A belt 15 extends between the pulleys to transmit the rotation of the motor to the spindle. A pair of holding shafts 5, 5' are provided symmetrically on the opposite sides of the spindle. A pair of tape reels 4, 4' are rotatably supported on the holding shafts, respectively, by a pair of springs 6, 6' which apply a braking force to the reels, and a pair of nuts 7, 7' holding the springs. The spindle is provided with guide rollers 9, 10 for a tape 8. A core 11 is passed through the axial bore of the spindle. The tape reel 4 carrying a supply of tape 16 is mounted on the holding shaft 5, and the tape is passed around the guide rollers and fastened to the core. If the spindle is rotated and the core is advanced in the direction of an arrow in FIG. 1, the tape is unwound from the supply of tape and wound on the core. The winding mechanism on the opposite side of the spindle is used in the same way.

In the apparatus hereinabove described, the tape reel is rotated about the core to wind the tape spirally on the core. If its rotating speed is increased, a centrifugal force and a wind pressure cause the failure of the tape to be fed smoothly and wound properly on the core. The wind pressure creates a particularly great amount of trouble. As the tape reel is relatively large and constitutes a large resistance to the air, it agitates the ambient air and creates a strong wind if it is rotated at a high speed. This wind renders the movement of the tape unstable, and even causes it to come off the guide rollers if the tape tension is insufficient.

SUMMARY OF THE INVENTION

It is an object of this invention to provide an improved tape winding apparatus which can maintain stability in the travel of tape even if it is rotated at a high speed.

The apparatus of this invention essentially comprises a device provided between a tape reel and a core for changing the tension of a tape in such a manner that its tension may be higher in an area close to the tape reel than in an area close to the core, and a wind barrier provided between those two areas. In the area close to the tape reel where a high wind pressure is created, the travel of tape is stabilized by its higher tension. In the area close to the core where the tape has a lower tension, the wind barrier shields the high wind pressure and ensures stability in the travel of the tape so that its tension may be sufficiently low when it is wound on the core.

The foregoing and other objects, features and advantages of the invention will be apparent from the following more particular description of a preferred embodiment of the invention, as illustrated in the accompanying drawings.

DETAILED DESCRIPTION OF THE INVENTION

Figure 1:
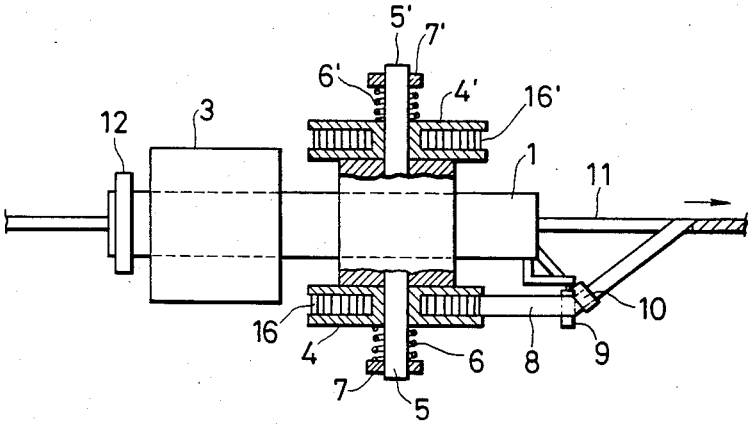
FIG. 1 PRIOR ART
FIG. 1 is a top plan view, partly in section, of a conventional tape winding apparatus.
Figure 2:
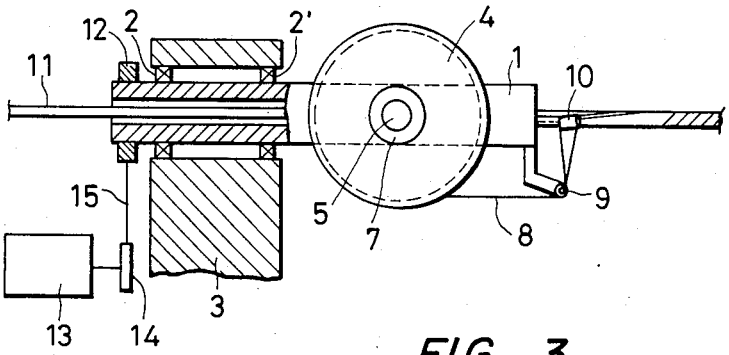
FIG. 2 PRIOR ART
FIG. 2 is a front elevational view, partly in section, of the apparatus shown in FIG. 1.
Figure 3:
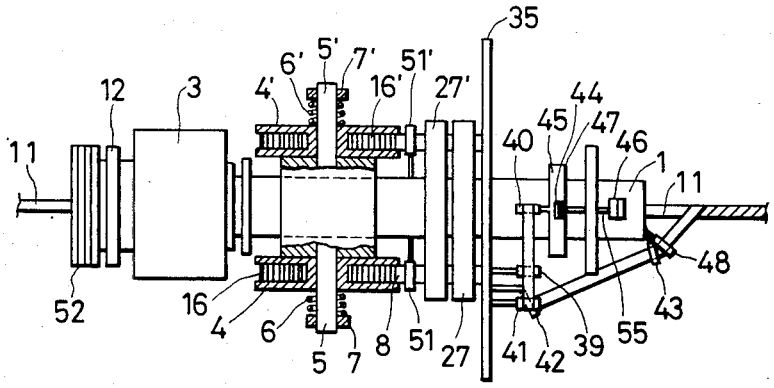
FIG. 3 is a top plan view, partly in section of an apparatus embodying this invention.
Figure 4:
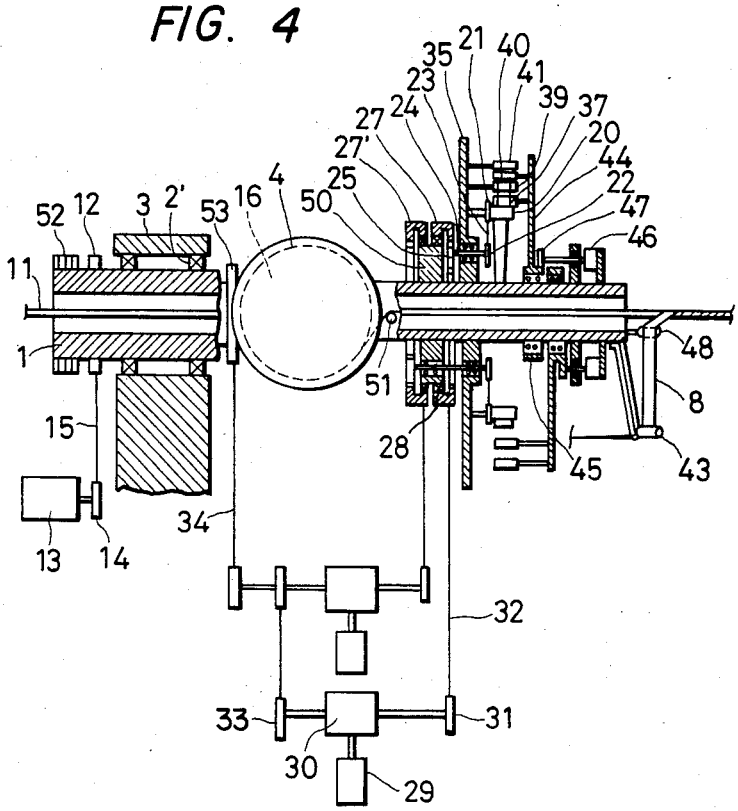
FIG. 4 is a front elevational view, partly in section of the apparatus shown in FIG. 3.
Figure 5:
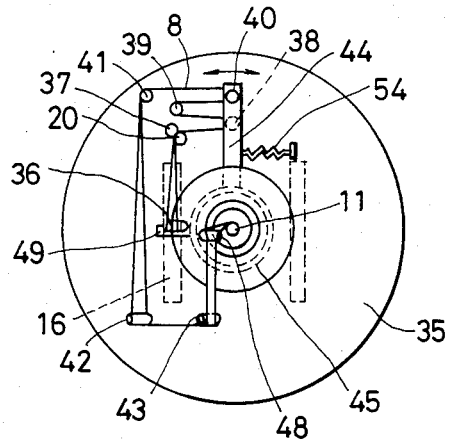
FIG. 5 is a side elevational view of the apparatus shown in FIG. 4.

Referring to FIGS. 3 to 5 of the drawings, an apparatus embodying this invention includes various parts which are essentially identical to their counterparts in the conventional appatratus. Those parts, for example, a spindle, tape reels and a mechanism for rotating them, are shown in FIGS. 3 to 5 by the same numerals as in FIGS. 1 and 2.

According to this invention, a disk shaped wind barrier 35 is provided between the tape reels 4 and 4' and that portion of the core 11 at which the tape 8 is wound thereon. The wind barrier 35 is provided with a driven tape takeup roller 20 associated with a pinch roller 37. A belt wheel 21 is connected to the takeup roller 20, and a belt 23 extends between the belt wheel 21 and a belt wheel 22 to drive the takeup roller 20. A block 50 is secured to the spindle 1, and an internally toothed gear ring 27 is rotatably supported about the block 50 by bearings 28. A gear 25 is engaged with the gear 27. A shaft 24 has one end connected to the gear 25 and extends through the wind barrier 35, while the other end of the shaft 24 is connected to the belt wheel 22. A variable speed motor 29 has an output connected by a differential gear box 30, a belt wheel 31 and a belt 32 to a belt wheel formed on the outer periphery of the internally toothed gear ring 27. A belt wheel 53 is secured to the spindle 1 and connected by a belt 34 to a correction shaft drive pulley on the differential gear box 30. The differential gear box 30 maintains constant the difference in rotating speed between the spindle 1 and the gear ring 27, i.e., the ratio between the rotating speed of the gear ring 27 relative to the spindle 1 and the rotating speed of the motor 29. Therefore, it is possible to control the rotating speed of the takeup roller 20 if the rotating speed of the motor 29 is controlled.

The wind barrier 35 is provided with guide rollers 36, 39, 41 and 42. A tension control arm 44 is supported by a bearing ring 45 on the spindle 1, and rotatable in the directions of arrows in FIG. 5. Guide rollers 38 and 40 are secured to the arm 44, and a spring 54 urges the arm 44 in one direction. A gear is formed on the outer periphery of the bearing ring 45, and engaged with a gear 47 to rotate it upon rotation of the arm 44. The gear 47 is connected by a shaft 55 to a displacement detector 46 secured to the spindle 1.

Guide rollers 43 and 48 are provided at the end of the spindle 1, and are adjustable to wind the tape 8 on the core at an appropriate angle.

In operation, the tape 8 is unwound from the tape supply 16, and passed about a guide roller 51 secured to the spindle 1, through a hole in the block 50 and a hole 49 in the wind barrier 35, about a guide roller 36 by which the tape is bent at right angles, and about the takeup roller 20. The tape 8 is firmly held between the takeup roller 20 and the pinch roller 37. The tape 8 extends between the guide rollers 38 and 40 on the tension control arm 44 and the guide rollers 39 and 41 on the wind barrier 35, and about the guide rollers 42, 43, and 48, and is fastened to the core 11. If the spindle 1 is rotated, the tape 8 is wound on the core 11. The output signal of the displacement detector 46 is transmitted through a slip ring 52 to a controller not shown to control the rotating speed of the motor 29 to thereby adjust the rotation of the takeup roller 20.

The apparatus shown in the drawings is so designed as to wind two tapes on the core. The other tape can be wound on the core in a similar way by the mechanisms shown by the same numerals carrying the apostrophes, for example, the tape reel 4'.

In the apparatus described above, the tension of the tape 8 in the area between the tape supply 16 and the takeup roller 20 can be controlled independently of its tension in the area between the takeup roller 20 and the core 11 on which it is wound. In the former area, the braking force applied by the spring 6 to the tape supply 16 maintains a high tension which is, however, lower than the level at which the tape is likely to break. In the latter area, the spring 54 fastened to the control arm 44 maintains a relatively low tension which is required to enable the tape to be wound properly on the core 11.

The high tension of the tape in the area between the tape pad 16 and the takeup roller 20 protects the tape against any influence by a strong wind created by the fast rotation of the tape reel 4 when the spindle 1 is rotated at a high speed. The wind barrier 35 disposed between the tape reel 4 and the takeup roller 20 deflects the strong wind created by the tape reel 4 radially outwardly so that it may not reach the takeup roller 20. The wind created by the tape reel 4 does not exert any influence on the tape in the area between the takeup roll 20 and the core 11 where its tension is low. Thus, the apparatus ensures stability in tape travel and its proper winding on the core at a satisfactorily low tension, even if the spindle is rotated at a high speed.

Although the invention has been described with reference to a preferred embodiment thereof, it is to be understood that modifications or variations may be easily made by anybody of ordinary skill in the art without departing from the scope of this invention which is defined by the appended claims. For example, it would be possible to consider an apparatus for winding a single tape, or three or more tapes. It would be possible to consider a greater number of areas in which the tension of the tape is varied. Moreover, the wind barrier may be of any other shape, for example, cylindrical. The influence of the wind created by the tape reel can also be reduced if the takeup roller is placed at a greater distance from the tape reel.

What is claimed is:

1. In a tape winding apparatus including a rotatable spindle having an axial bore through which a core passes on which a tape is to be wound to produce a cable, and a reel carrying a roll of tape supported on said spindle for rotation about said core with the rotation of said spindle, the improvement comprising:

tension imparting means, provided between said reel and said core, for defining at least two areas therebetween, whereby a first tension of said tape nearer said reel is greater than a second tension of said tape nearer said core, whereby said second tension is not dependent on said first tension;

means for varying said second tension in accordance with said rotation of said spindle, said tension varying means comprising:

a differential gear box connected to said spindle and said tension imparting means and having first, second, and third shafts; and a plurality of pulleys and belts for connecting one side of said differential gear box to said spindle, and for connecting another end of said differential gear box to said tension imparting means, whereby a difference in rotational speed between the rotation of said spindle and the rotation of said tension imparting means about said core is maintained substantially constant;

the improvement further comprising:

a wind barrier provided between said areas for preventing transfer of a wind created by rotation of said reel from one area to the other area.

2. An apparatus as set forth in claim 1 wherein said wind barrier comprises a disk secured to and encircling said spindle.

3. An apparatus as set forth in claim 2 wherein said tension importing means comprises a driven tape takeup roller mounted on the side of said disk opposite said reel, and a tension controller provided between said takeup roller and said core for controlling the rotating speed of said takeup roller to maintain said tape therebetween at a satisfactorily low tension which ensures proper winding of said tape on said core.

4. An apparatus as set forth in claim 2 wherein said tension imparting means comprises spring means associated with said reel to maintain said tape under high tension to resist said wind.

5. A tape winding apparatus as set forth in claim 1, wherein said tension imparting means comprises a tension control arm, a takeup roller, and an internally-toothed gear ring connected to said takeup roller, said tension control arm outputting a displacement signal, tension in said second tension zone being maintained constant by controlling said variable speed motor in response to said displacement signal, and wherein said tension varying means further comprises:

a variable speed motor connected to said differential gear box through said first shaft, a speed of said variable speed motor being controlled in accordance with said displacement signal; and wherein said plurality of pulleys and belts includes:

a first pulley connected to said second shaft;

a second pulley connected to said spindle;

a first belt connecting said first and second pulleys, for rotating said first pulley in accordance with rotation of said spindle;

a third pulley connected to said third shaft; and a second belt connecting said second pulley and said internally-toothed gear ring, for driving said takeup roller via rotation of said second pulley, a speed ratio between said takeup roller and said variable speed motor being maintained constant by controlling a rotational speed of said internally toothed gear ring relative to a rotational speed of said variable speed motor.

* * * * *